United States Patent [19]

Biermann et al.

[11] 4,276,837

[45] Jul. 7, 1981

[54] WELT FEEDER FOR SEWING MACHINES

[75] Inventors: Kurt Biermann; Kurt Reinke, both of Bielefeld, Fed. Rep. of Germany

[73] Assignee: Dürkoppwerke GmbH, Bielefeld, Fed. Rep. of Germany

[21] Appl. No.: 117,770

[22] Filed: Feb. 1, 1980

[30] Foreign Application Priority Data

Feb. 2, 1979 [DE] Fed. Rep. of Germany ... 7902807[U]

[51] Int. Cl.[3] ..... D05B 35/06; D05B 69/20

[52] U.S. Cl. ..... 112/152; 112/277

[58] Field of Search ..... 112/152, 147, 136, 275, 112/277, 272, 52

[56] References Cited

U.S. PATENT DOCUMENTS

| | | | |
|---|---|---|---|
| 2,840,020 | 6/1958 | Wise | 112/152 |
| 3,334,603 | 8/1967 | Boser et al. | 112/152 |
| 4,112,860 | 9/1978 | Ellington et al. | 112/147 X |
| 4,160,424 | 7/1979 | Newell et al. | 112/275 |

*Primary Examiner*—Peter P. Nerbun

*Attorney, Agent, or Firm*—Karl F. Ross

[57] ABSTRACT

A device for feeding to a sewing machine a strip of fabric, in particular a longitudinally folded band to serve as a pocket welt, comprises a generally oval-shaped guide mountable on the sewing-machine base and provided with sides shaped as U-profiles and with a tongue at an output end for folding a fabric strip upon passage thereof along a feed path to a sewing station at the machine. A beam of light from a gallium-arsenide source traverses the feed path in the region of the tongue to energize a photocell upon passage of a workpiece, the photocell being connected to a stitch counter for activating the same upon energization by the source. The guide has a length scale with graduations spaced in the direction of the feed path for implementing the manual positioning of a fabric strip prior to the feeding thereof to the sewing station, while the stitch counter is operationally coupled to the reciprocating sewing-needle drive to arrest the same upon counting a predetermined number of stitches. The positioning of a fabric strip via the scale and the automatic stopping of the sewing-machine drive by the photocell-activated counter ensure a precise positioning of a final stitch relative to a sewn welt.

4 Claims, 5 Drawing Figures

WELT FEEDER FOR SEWING MACHINES

FIELD OF THE INVENTION

Our present invention relates to a fabric feeder for sewing machines. More particularly, our present invention relates to a feeder for edge-parallel folding of a workpiece to form a pocket welt and for controlling seam and incision length.

BACKGROUND OF THE INVENTION

Sewing machines for attaching welts to pockets generally include a pair of sewing needles and a plurality of cutting edges for forming a pocket opening with V-shaped corner incisions as embodied by Dürkopp machines 238N-313105, 238N-513105, 746-7/E13 and 746-7E40 shown in sections 31–34 of the 1979 Dürkopp catalogue. A welt is fed to a sewing station at the machine by a device for edge-parallel folding of a fabric strip. Usually, the beginning and the end of a welt seam is marked on the material to be sewn.

The main disadvantage of this technique is due to the necessity for decreasing the stitching speed to enable the sewing-machine operator to stop the machine at the marked end location.

There are devices, as indicated in the above-mentioned Dürkopp catalogue sections, for at least semi-automatically controlling a final stitching to a pocket of a welt having an attached pocket flap, such devices including a reflected-light detector for monitoring the passage of a back edge of the welt flap during feeding of the welt to the sewing station. Upon detecting a flap end, the detector activates a stitch counter which arrests the sewing-needle drive upon reaching a predetermined stitch count. Such a count is generally small, which condition facilitates the rapid sewing of a welt seam to a terminal stitch at a precise location relative to the edges of the welt. A disadvantage of this technique is that it may be not applied to flapless welts without incurring significant deviations in the ending points of the welt seams. Because a flapless welt does not lend itself to accurate monitoring by a reflected-light detector, the counter must number the stitches for the entire length of a seam, whereby errors arise from such sources as varying feed rates.

OBJECTS OF THE INVENTION

The object of our present invention is to provide an improved fabric-feed device of the above-mentioned type, facilitating rapid stitching of flapless-welt seams.

SUMMARY OF THE INVENTION

At a sewing machine having a reciprocating needle drive and a stitch counter for arresting the same, a device combinable therewith for feeding a workpiece to a sewing station comprises, according to our present invention, a guide for conducting the workpiece along a feed path to the station, a marker on the guide for implementing the manual positioning of the workpiece prior to the feeding thereof to the station, and a monitor disposed on the guide and connected to the counter for activating the same upon detecting the passage of the workpiece during the feeding thereof to the station. The counter stops the drive after reaching a predetermined count threshold upon activation by the monitor, thereby controlling the position of a final stitch relative to the workpiece.

The monitor includes a photocell connected to the counter for emitting an activation signal thereto upon detecting the back edge or end of a workpiece during feeding thereof to the sewing station, and a light source for emitting to the photocell a light beam extending substantially horizontally and transversely to the feed path, whereby the beam is interrupted by the workpiece and energizes the photocell upon the passage of the workpiece. Preferably, the source is of the gallium-arsenide type, and the marker on the guide includes a distance or length scale with graduations spaced from one another in a direction parallel to the feed path.

According to another feature of our present invention, the guide includes an elongate generally oval-shaped funnel with U-shaped sides for folding a workpiece upon feeding thereof to the sewing station, the funnel sides being provided with two apertures disposed relative to one another transversely to the feed path, the source and the photocell being juxtaposed outside the funnel to respective apertures.

BRIEF DESCRIPTION OF THE DRAWING

These and other features of our present invention will not be described in detail, reference being made to the accompanying drawing in which.

SPECIFIC DESCRIPTION

Figures 1, 2, 3, 4, 5:
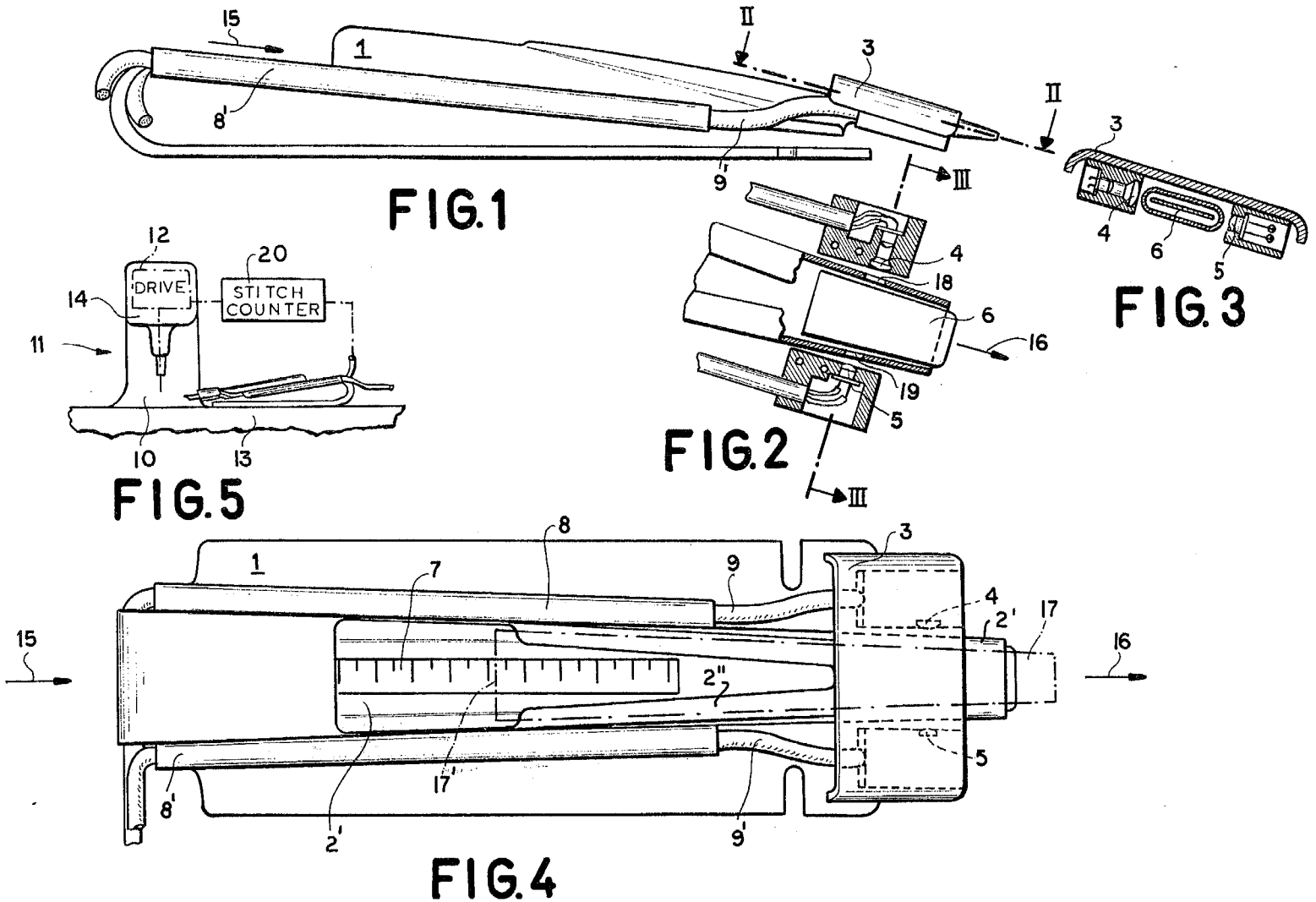
FIG. 1 is an elevational view of a fabric feeder for sewing machines, according to our present invention.
FIG. 2 is a partial cross-section taken along line II—II in FIG. 1.
FIG. 3 is a partial cross-section taken along line III—III in FIG. 2.
FIG. 4 is a plan view of the device shown in FIG. 1.
FIG. 5 is a schematic elevational view of the feeder of FIG. 1, shown in combination with a sewing machine.

As shown in the drawing, a device for feeding fabric to a station 10 (FIG. 5) at a sewing machine 11 with a reciprocating sewing-needle drive 12 comprises, according to our present invention, a generally oval-shaped funnel 2 rigid with a mounting bracket 1 and inclined slightly with respect to the horizontal. As shown in FIG. 5, the device may be secured to a base plate 13 or sewing table or may be pivotably attached to a sewing-machine head 14.

As illustrated in FIG. 4 funnel 2 is provided on an inside bottom surface 2' with a length or distance scale 7 having graduations, preferably in millimeters, spaced from one another in a direction parallel to a feed path indicated in the drawing by input arrows 15 and output arrows 16. As shown in FIG. 5, funnel 2 has an opening in an upper surface 2'' for enabling an operator to accurately position a workpiece 17, prior to feeding the same to sewing station 10, by comparing a back end or edge 17' of the workpiece with the graduations on scale 7 upon inserting the workpiece 17 into funnel 7 at input 15. As best seen in FIG. 3, funnel 2 has curved flanks, preferably U-shaped, for folding workpiece 17 along its longitudinally extending edges to form a braided strip to be sewn as a welt on another workpiece (not shown) at station 10; the funnel or guide 2 is also provided at an output end with a tongue 6 (FIGS. 2 and 3) for facilitating the folding process. Upon the sewing of welt 17 to another workpiece, e.g. a pocket, at station 10, the fabric-feed mechanism or dogs (not illustrated) of sewing machine 11 pull welt 17 through guide 2.

As best seen in FIG. 2, a light source 4 and a photocell 5 are mounted on opposite sides of guide 2 near the output end thereof via a plate 3 (FIGS. 1, 3 and 5) extending over the guide. Light source 4, preferably of the gallium-arsenide type, emits a light beam transversely to path 15, 16, this beam traversing a pair of apertures 18, 19 disposed in the U-shaped sides of guide 2 across path 15, 16 from one another. Source 4 and photocell 5 are respectively connected to an energizing supply (not shown) and to a stitch counter 20 (FIG. 5) via respective cables 9, 9′ which are held for at least a portion of their lengths alongside funnel 2 by support tubes 8, 8′ rigid therewith.

Source 4 and photocell 5 function as a monitor emitting a signal via cable 9′ to counter 20 upon detecting the passage of back edge 17′ during the feeding of welt 17 to sewing station 10. Thus, the transverse illumination of monitor 4, 5 is interrupted by the workpiece and is reinstated upon the passage thereof to energize photocell 5. Counter 20 is activated by the photocell-generated signal to count a predetermined number of stitches and subsequently to arrest drive 12, whereby a final stitch is executed in the welt 17 at a predetermined position relative to back edge 17′. Drive 12 may also be controlled by the stitch counter 20 in response to a signal from monitor 4, 5 to sew, for example, a lock stitch in welt 17 at a precise location relative to the end edge 17′. An advantage of a device according to our present invention lies in the fact that the sewing done in the interval between the detection of the back edge 17′ by monitor 4, 5 and the formation of the final stitch may be performed at any rate within the range of machine 11 without affecting the precise disposition of the final stitch. Such precision is due at least in part to the shortness of the material remaining to be sewn upon the passage of the welt back end 17′ by the monitor 4, 5.

It is to be noted that a device according to our invention may be used for feeding and strip- or band-shaped workpiece, such as a zipper, to sewing station 10. Generally, machine 11 has a pair of sewing needles with a vertially reciprocating cutting edge therebetween and further cutters for forming a V-shaped end on a workpiece.

We claim:

1. At a sewing machine having a reciprocating sewing-needle drive and a stitch counter for arresting same upon reaching a predetermined count, the combination therewith of a device for feeding a workpiece to a sewing station, said device comprising:

guide means for guiding said workpiece along a feed path extending to said station;

marker means on said guide means for implementing the manual positioning of said workpiece prior to the feeding thereof to said station;

a photocell on said guide means connected to said counter for activating same upon detecting the passage of a back edge of said workpiece during feeding thereof to said station; and a light source disposed on said guide means across said path from said photocell for emitting thereto a light beam extending substantially transversely to said path, whereby a beam interrupted by said workpiece is reinstated upon passage thereof to energize said photocell.

2. The combination defined in claim 1 wherein said marker means includes a distance scale with graduations spaced from one another parallel to said path.

3. The combination defined in claim 1 or 2 wherein said source is a gallium-arsenide source.

4. The combination defined in claim 1 or 2 wherein said guide means includes an elongate generally oval-shaped funnel with U-shaped sides for folding a workpiece upon feeding thereof to said station, said sides being provided with two apertures relatively disposed transversely to said path, said source and said photocell being juxtaposed outside of said funnel to respective apertures.

* * * * *